United States Patent [19]

Bando

[11] Patent Number: 4,822,262

[45] Date of Patent: Apr. 18, 1989

[54] ROTARY ENGINE HAVING ROLLERS FOR THE APEX SEAL

[75] Inventor: Yoshihiro Bando, Tokushima, Japan

[73] Assignee: Bando Kiko Co., Ltd., Tokushima, Japan

[21] Appl. No.: 240,434

[22] Filed: Sep. 1, 1988

Related U.S. Application Data

[63] Continuation of Ser. No. 931,795, Nov. 18, 1986, abandoned.

[30] Foreign Application Priority Data

| | | | |
|---|---|---|---|
| Nov. 19, 1985 | [JP] | Japan | 60-260449 |
| Jun. 23, 1986 | [JP] | Japan | 61-147281 |
| Aug. 2, 1986 | [JP] | Japan | 61-182546 |

[51] Int. Cl.[4] ..... F01C 19/04; F01C 19/08; F01C 21/00

[52] U.S. Cl. ..... 418/120; 418/122; 418/142; 418/235

[58] Field of Search ..... 418/120, 121, 122, 123, 418/113, 142, 235

[56] References Cited

U.S. PATENT DOCUMENTS

| | | | |
|---|---|---|---|
| 2,048,825 | 7/1936 | Smelser | 418/235 |
| 2,536,938 | 1/1951 | Hunter | 418/235 |
| 3,033,180 | 5/1962 | Bentele | 418/123 |
| 3,277,873 | 10/1966 | Brodbeck et al. | 418/122 |
| 3,961,871 | 6/1976 | Kurio | 418/123 |
| 4,329,129 | 5/1982 | Ishizuka et al. | 418/235 |

*Primary Examiner*—John J. Vrablik
*Assistant Examiner*—Leonard P. Walnoha
*Attorney, Agent, or Firm*—Michael N. Meller

[57] ABSTRACT

A rotary engine in which rollers are inserted between the side wall of a seal groove and an apex seal such that the side wall of the seal groove and the apex seal are brought into rolling contact, the rollers are enhoused within a recessed groove formed in the side wall of the seal groove or in the side surface of the apex seal, and both ends of the recessed groove are enhoused in the corner seals assembled at both ends of the rotor so that the recessed groove is sealed.

1 Claim, 3 Drawing Sheets

Fig. 5
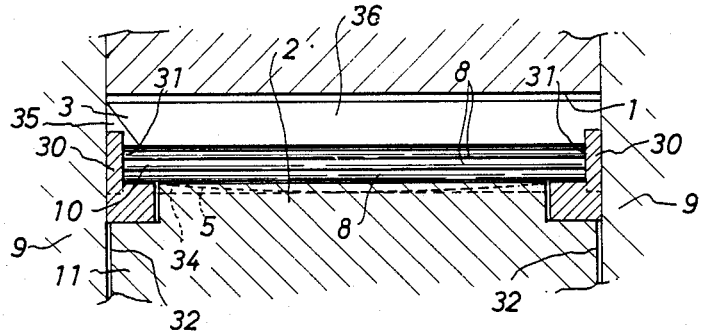
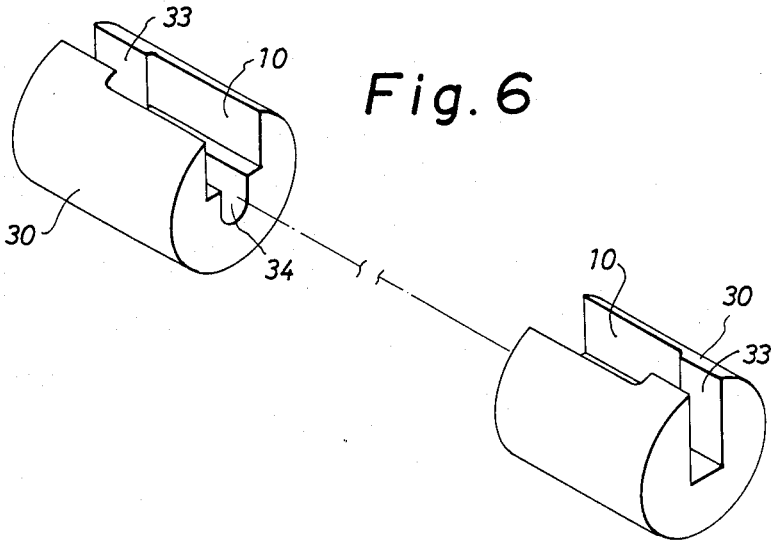
Fig. 6
Fig. 7
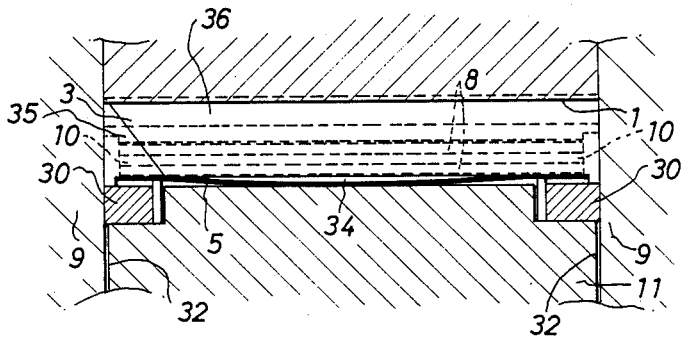

ROTARY ENGINE HAVING ROLLERS FOR THE APEX SEAL

This is a continuation of application Ser. No. 931,795, filed 11-18-86, now abandoned.

FIELD OF THE INVENTION

This invention concerns an apex seal for a rotary engine.

BACKGROUND OF THE INVENTION

In a conventional rotary engine in which a rotor undergoes planetary rotation in a space which is defined by a trochoidal inner circumferential surface or a sliding surface of a rotor housing, and which has a major diameter portion and a minor diameter portion and is sealed by apex seals embedded in seal grooves disposed in the rotor along the rotation axis of the rotor, the apex seals undergo a centrifugal inertia which is increased along with the increase in the rate of rotor rotation, radially from the rotating center of the rotor. The apex seals also undergo a frictional force from the side wall surface of the groove due to the combustion gas pressure as the rotor rotates during operation of the rotary engine. The apex seal is urged against the sliding surface at the major diameter portion within the rotor housing by the outward centrifugal force from the rotating center of the rotor, whereas the apex seal is urged inwardly from the sliding surface of the rotor housing as the apex seal approaches the minor diameter portion in which an inertia is exerted in the direction opposite to that in the major diameter portion to separate the apex seal from the sliding surface of the rotor housing at the convexedly curved surface of the minor diameter portion. That is, the apex seal is floated in this case. In view of the above, for preventing the apex seal from separating (skipping) at the convexedly curved surface, an apex seal spring is disposed between the rotor and the apex seal for urging the apex seal toward the sliding surface of the rotor housing. However, since a frictional force is present between the apex seal and the side wall surface of the seal groove, there is a delay in the radial response of the apex seal due to the spring resiliency for the floating action exerted on the apex seal at the convexedly curved surface in the case when there is an abrupt change in the curved configuration of the sliding surface and, as a result, the apex seal is floated. Therefore, the gases compressed in the combustion chamber cause leakage, to worsen the fuel efficiency as compared with reciprocal engines.

SUMMARY OF THE INVENTION

The object of this invention is to provide a rotary engine in which the gas tightness between the sliding surface of a rotor housing and an apex seal is improved by facilitating the radial movement of the apex seal. A more specific object of this invention is to provide a rotary engine in which the gas tightness between the sliding surface of the rotor housing and the apex seal is further improved by reducing the frictional force between the apex seal and the seal groove while maintaining the gas tightness therebetween, thereby facilitating the radial movement of the apex seal to render the movement of the apex seal due to the spring resiliency and response due to the gas pressure more sensitive and prevent the floating of the apex seal.

For attaining the foregoing object in the rotary engine according to this invention, elongate rollers disposed along a seal groove are enhoused between the inner wall surface of the seal groove disposed at each of the apex portions of the rotor and the side surface of the apex seal, so that the apex seal and the rollers are brought into rolling contact. The apex seal can move smoothly to the radial direction under the rolling contact and, further, gas tightness between the side surface of the apex seal and the inner wall surface of the seal groove can be maintained.

In the one of embodiments according to the invention, the rollers are disposed over the entire width along the axial direction of the apex seal as much as possible for attaining smoother radial movement of the apex seal. That is, the rollers are preferably disposed throughout the rotor over the entire width in the direction along with the rotary axis of the rotor. However, if the roller is disposed throughout the rotor completely over the entire width, the roller groove for containing the rollers are opened at both of the end faces of the rotor and, in this case, combustion gases compressed in the rotor housing leak from the openings by way of the seal groove and the roller groove of the apex seal to remarkably reduce the combustion efficiency of the rotary engine. Accordingly, the seal groove of the rotor has been fabricated such that both of the end faces of the rollers are not exposed, that is, the seal groove is formed such that it is not opened at both of the ends thereof. However, fabrication of the seal groove in such a way is very much difficult and troublesome thus not suitable to the mass production.

Accordingly, it is another object of this invention to provide a rotary engine capable of mass production at a reduced cost, in which the radial movement of the apex seal is facilitated such that the apex seal can move while smoothly tracking the change at the curved shape of the sliding surface of the rotor housing thereby improving the gas tightness between the apex seal and the sliding surface, as well as reducing the leakage of the combustion gas from the end faces of the rotor.

The foregoing object can be attained by the rotory engine according to this invention, in which the seal groove is formed at first such that both end faces of the rollers are exposed, that is, both ends of the seal groove are opened and then a member for covering the opening, for example, a corner seal is formed so as to each of constitute a portion of the seal groove and attached to each of the openings thereby ensuring the gas tightness of the rotor against the side housings.

BRIEF DESCRIPTION OF THE DRAWING

This invention will now be explained by way of preferred embodiments thereof referring to the drawings.

FIG. 5 is a fragmentary side elevationl view for the cross section taken along line V—V in FIG. 4, FIG. 6 is a perspective view for the corner seal in the second embodiment, and FIG. 7 is a fragmentary side elevational view for the cross section taken along line VII—VII in FIG. 4.

DETAILED DESCRIPTION OF THE PREFERRED EMBODIMENTS

Figure 1:
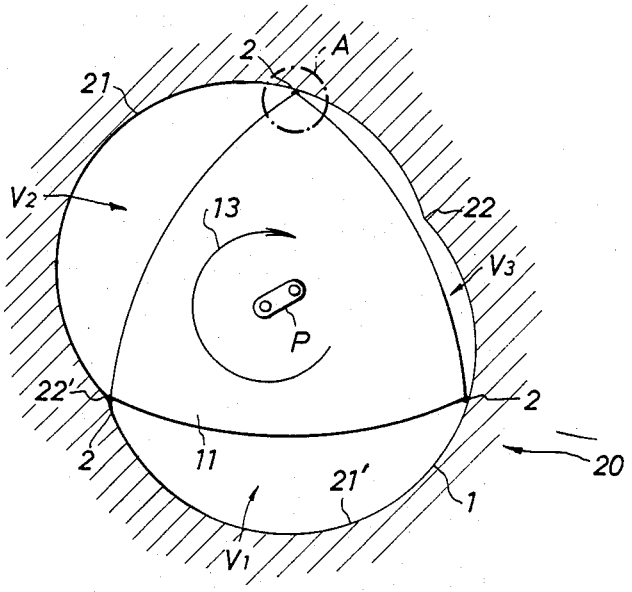
FIG. 1 is a front elevational view for the cross section of a rotary engine according to this invention.

In FIGS. 1 through 7, there are shown a sliding surface 1 of a rotor housing 20, apex portion 2 of rotor 11, apex seal 3, seal groove 4, low-shaped apex seal spring 5, inner wall surface 6 of the seal groove 4, roller 8 and corner seal 30.

Figure 2:
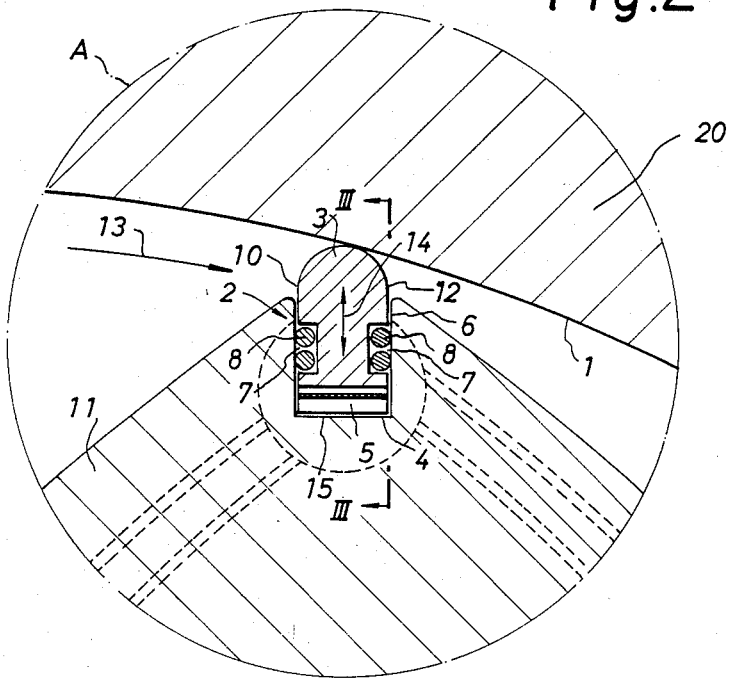
FIG. 2 is an enlarged view of a first embodiment at a portion A shown in FIG. 1.
Figure 3:
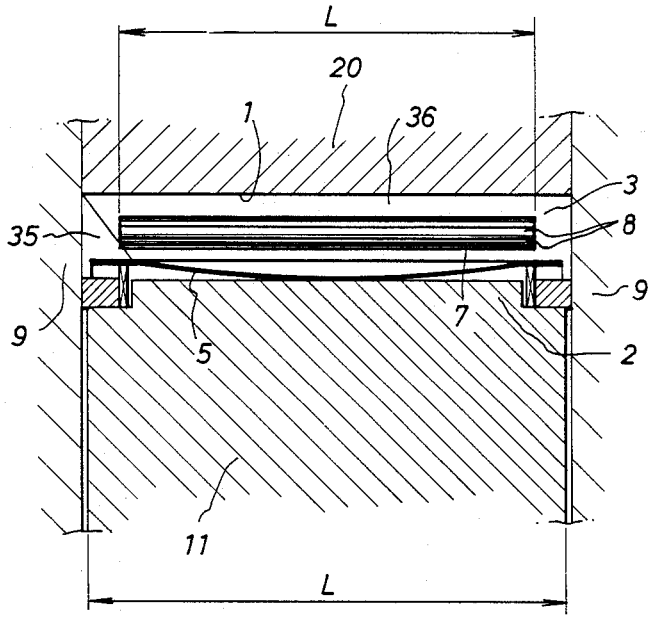
FIG. 3 is a fragmentary side elevational view for the cross section taken along line III—III in FIG. 2.

As shown in FIG. 1, the rotor 11 rotates around rotary shaft P as the center with each of the apex portions 2 of the rotor 11 being in contact with the sliding surface 1 of the rotor housing 20 respectively. Accordingly, operation chambers V1, V2 and V3 for conducting the combustion, exhaustion and suction have to be independent of each other in a gas tight manner respectively. For this purpose, as shown in FIGS. 2 and 3, the seal groove 4 is formed at each of the apex portions 2 and the apex seal 3 is disposed therein for obtaining the gas-tight condition. The apex seal 3 is composed of members 35 and 36. Now, in accordance with this invention, recessed groove 7 is formed in the first and second side surfaces 10, 12 of the apex seal 3 respectively, a plurality of elongate rollers 8 which extend along the recessed groove 7, are arranged within the recessed grooves 7. The rollers 8 are brought into rolling contact with the first or second side surface 10, 12 of the apex seal 3 and the inner wall surfaces 6 of the seal groove 4 respectively. Accordingly, the rollers are able to rotate smoothly within the recessed groove 7.

The roller 8 used herein is preferably made of metal so that less softening or degradation will result upon undergoing the effect of heat caused by the gas combustion. High speed steels are used in this invention.

The roller 8 is generally in an elongate shape of from 1 to 0.5 mm diameter and length L′ shorter than the entire length L of the rotor 11 as shown in FIG. 3.

As shown in FIG. 2, the recessed grooves 7 for housing the rollers 8 are formed in both first and second surfaces 10, 12 of the apex seal 3 respectively and the rollers 8 are arranged in the recessed grooves 7 as shown in FIG. 2. That is, the recessed grooves 7 are formed in the side surfaces 10, 12 of the apex seal 3 and the second side surface 12 of the apex seal 3 is urged by the pressure of the combustion gases (particularly compressed gases) toward the inner opposing wall surface 6 of the seal groove 4.

That is, the sets of rollers 8 are respectively disposed on both sides of the apex seal 3 as shown in FIG. 2. And each set of rollers 8 is assembled in the respective recessed groove 7 formed in first and second surfaces 10, 12 of the apex seal 3.

Since the apex seal 3 is supported by the rotatable rollers 8 when the apex seal 3 is urged toward the wall surface 6 of the seal groove 4 due to the difference between the pressure of the combustion gases and the pressure of the gases in the operation chamber, it can readily move smoothly in the radial direction 14 and can move with a sensitive response the resiliency of the low-shaped apex seal spring 5, the pressure of gas tightly sealed to the bottom 15 of the seal groove 4, and the like, so that the apex seal 3 can be prevented from floating at the abrupt transitions 22, 22′ between concaved curved surfaces 21, 21′ of the rotor housing 20 (see FIG. 1).

Accordingly, the apex seal 3 can always be brought into contact with the sliding surface 1 of the rotor housing 20, by which gas tightness between each of the operation chambers V1, V2 and V3 can further be improved.

Further, since the rollers 8 are in contact with the inner wall surface 6 of the seal groove 4 and the apex seal 3, gas tight lines are formed respectively at the lines of contact. By accommodating two or more of the rollers 8, gas tightness can further be ensured.

Figure 4:
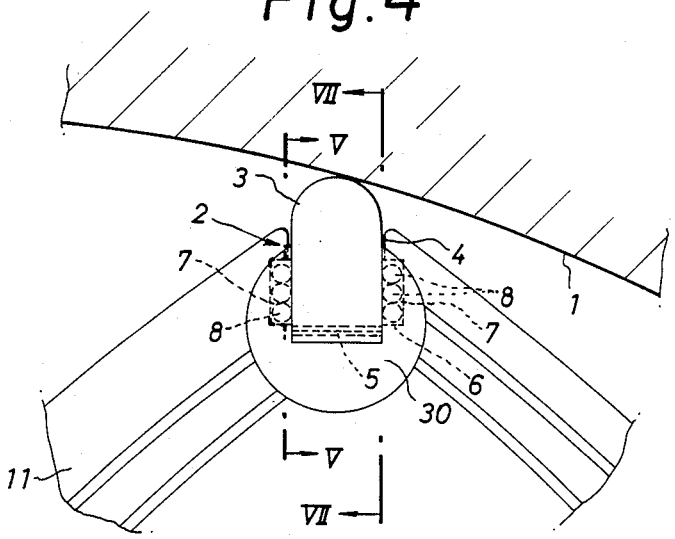
FIG. 4 is an enlarged view for the second embodiment in the portion A shown in FIG. 1.

In another embodiment according to this invention shown in FIGS. 4 and 5, a recessed groove 7 is formed on each inner surface wall 6 of the seal groove 4 each recessed groove 7 being disposed in a direction aligned with the rotary axis P, and a plurality of elongate rollers 8 are arranged within each recessed groove 7, whereby the apex seal 3 is brought into rolling contact with the inner wall surface 6 of the seal groove 4.

Cover members, that is, corner seals 30, are arranged respectively at both side ends 32 of the rotor 11 and in contact with the side housing 9. The rotor 11 is arranged to have a portion between the corner seals 30 and the ends of the rollers 8 are received in corresponding channels formed in the corner seals, whereby the ends faces 31 of the rollers 8 are not exposed.

Each of the corner seals 30 generally has a cylindrical pin-like shape, the cylinder being partially cut to have a first hollow portion 33 and a second hollow portion 10 as shown in FIG. 6. The first hollow portion 33 is used for receiving the end of the apex seal 3 and opened toward the side housing 9. The second hollow portion 10 is used for receiving the apex seal 3 and each of the ends of the rollers 8. The seciond hollow portion 10 is extended continuously from the recessed groove 7.

The apex seal 3 is supported by the rollers 8 under rolling nearly over the entire length in a direction substantially aligned with the center axis P and can move lightly and smoothly in the radial direction 14 (see FIG. 2) outwardly from the center axis. On the other hand, the recessed grooves 7 for enhousing the rollers 8 are sealed by the corner seals 30. Therefore, channels for the combustion gases (or pressurized gases) passing through the bottom 34 of the seal groove 4 are interrupted. As a result, leakage of these gases can be reduced to attain favorable gas tightness between each of the operation chambers V1, V2 and V3.

Having thus been constructed, in accordance with the rotary engine of the invention, during rotation of the rotor, the apex seals can follow the varying curvature of the inner surface of the rotor housing, whereby efficient engine operation can be attained. Further, since both ends of the seal grooves can be sealed respectively by the cover members, a high performance engine with further improved fuel efficiency can be obtained.

What is claimed is:

1. A rotary engine having two side housings opposed to each other, a rotor housing and a rotor rotatably mounted in said rotor housing which has a plurality of apex portions and first and second recesses formed in the respective ends of each of said apex portions, said rotary engine comprising:

a seal groove formed on each of said apex portions and extending in parallel with a rotary axis of the rotor, said seal groove having an inner wall surface;

an apex seal having first and second side surfaces and first and second ends, said apex seal being disposed within said seal groove wherein said apex seal can be displaced radially outwardly from said rotary axis;

at least one recessed groove formed on said inner wall surface of said seal groove;

a plurality of elongate rollers each having first and second ends and being disposed within said recessed groove whereby said inner wall surface of said seal groove is in rolling contact with said first side surface of said apex seal when said second side surface of said apex seal receives a pressure of combustion operation; and first and second corner seals respectively arranged in said first and second recesses so as to be able to contact said side housing airtightly, each of said corner seals having a first hollow portion for receiving an end of said apex seal and opened toward said side housing, and a second hollow portion for receiving said end of said apex seal and an end of each of said rollers, said second hollow portion being extended continuously from said recessed groove.

* * * * *